United States Patent [19]

Yoshida et al.

[11] 4,093,424

[45] June 6, 1978

[54] THERMOGENIC COMPOSITIONS

[75] Inventors: Risaburo Yoshida; Keisuke Kaiho; Yusaku Ide; Takeshi Hirose, all of Tokyo, Japan

[73] Assignee: Toyo Ink Manufacturing Co,, Ltd., Tokyo, Japan

[21] Appl. No.: 773,715

[22] Filed: Mar. 2, 1977

[30] Foreign Application Priority Data

| | | |
|---|---|---|
| Mar. 9, 1976 | Japan | 51-24700 |
| Apr. 13, 1976 | Japan | 51-40867 |
| Jun. 15, 1976 | Japan | 51-69297 |
| Jun. 15, 1976 | Japan | 51-69298 |
| Jul. 21, 1976 | Japan | 51-86051 |
| Dec. 9, 1976 | Japan | 51-147124 |

[51] Int. Cl.[2] ..... F24J 1/00; F24J 3/00; C09K 3/18

[52] U.S. Cl. ..... 44/3 C; 126/263; 252/70

[58] Field of Search ..... 44/3 R, 3 A, 3 B, 3 C, 44/3 D; 126/263; 106/13; 252/70

[56] References Cited

U.S. PATENT DOCUMENTS

| | | | |
|---|---|---|---|
| 1,812,243 | 6/1931 | Jost | 126/263 |
| 3,301,250 | 1/1967 | Glasser | 126/263 |
| 3,311,459 | 3/1967 | Francis et al. | 44/3 R |
| 3,951,127 | 4/1976 | Watson et al. | 126/263 X |

*Primary Examiner*—Carl F. Dees
*Attorney, Agent, or Firm*—Frank J. Jordan

[57] ABSTRACT

A thermogenic composition comprising (1) at least one compound such as an alkali metal sulphide, polysulphide, hydrosulphide, hydrate thereof or mixture thereof, (2) at least one catalytically functional compound such as carbonaceous material or iron carbide and, if desired, (3) at least one filler such as natural or synthetic staple fibers or aluminum oxide.

7 Claims, 8 Drawing Figures

THERMOGENIC COMPOSITIONS

Figure 1:
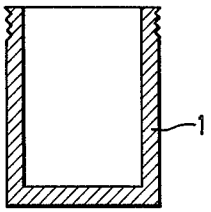

This invention relates to a novel thermogenic composition and more particularly to a thermogenic composition that generates a large amount of heat merely through contact with air without addition of water.

There have heretofore been known numbers of thermogenic compositions which use the thermogenic chemical phenomena as heat sources, for example:

(1) A composition of powder of iron, aluminum or the like and an inorganic oxidizing catalyst such as an iron sulphate, copper sulphate or iron chloride. The composition generates heat by by adding water thereto and coming in contact with oxygen.

(2) A composition the main component of which is an inorganic oxide such as calcium oxide that yields a large amount of heat by reacting with or dissolving in water. For generation of heat it requires pouring of water thereinto from outside.

(3) A composition made up of sodium or potassium hydroxide and a sulphate containing water of crystallization. It generates heat when the two components are brought into contact.

Of the above-mentioned compositions, those (1) and (2) are capable of generating satisfactory amounts of heat, but their use requires addition of large quantities of water from outside. This inconvenience largely limits the modes and scope of their practical applications.

The composition (3), on the other hand, has the advantage of requiring for heat generation the mere contact of the two components without water added from outside. But the heat, generated by dissolution and neutralization, is small in amount, bringing about a temperature not higher than about 60° C. Another disadvantage of the composition (3) is that the use of strong alkali powder as its component raises problem as to safety and storage.

The novel thermogenic composition of the present invention is free from the above-mentioned defects and inconveniences of conventional ones. The characteristics of the novel composition are set forth as follows:

(1) With no water fed from outside at all, but merely by bringing it into contact with oxygen in the air, this composition exhibits a higher thermogenic performance than the conventional ones. The highest temperature attainable and the duration of heat generation of the composition can be easily regulated by varying the degree of contact thereof with the air (oxygen), the weight ratio of the components thereof, and the like.

(2) The heating can be easily stopped or resumed by contact or non-contact with the air. The composition, unlike the conventional ones, does not require repeated addition of water thereto for sustained generation of heat, nor has it the defect that once the heating starts it cannot be stopped when desired.

(3) Since no water is used, the composition, during its exothermic reaction, does not evolve steam which might scald human bodies. The reaction does not yield a toxic gas, either. The composition is, therefore, a very safe one.

(4) The composition can be supplied in compact form, e.g., in sheet form, since its reaction does not require water addition and a small quantity of the composition is sufficient to yield a large amount of heat. Because of these advantages the composition have a wider range of applications than the conventional ones.

The composition of the present invention will be detailed hereinbelow:

Alkali metal sulphides, polysulphides or hydrates thereof, or hydrosulphides (hereinafter called A component) used in the preparation of the composition of this invention include alkali metal sulphides, polysulphides, hydrosulphides and hydrates thereof in powder form, the alkali metal being Li, Na, K, Rb, Cs or the like. These alkali metal compounds may be used singly or jointly as the A component. Of the alkali metals used in the preparation of the compounds, Na and K are preferred with Na being more preferred. These alkali metal compounds are thermally stable in the air and generate no heat for themselves. They yield heat, however, when mixed with a carbonaceous material (hereinafter called B component) such as carbon black and exposed to the air.

The B component is at least one compound selected from (1) carbonaceous materials, (2) iron carbide, (3) activated clay, (4) iron, nickel and cobalt sulphates and hydrates thereof, (5) derivatives of sulphonated anthraquinone, and the like. With respect to thermogenic capability, carbonaceous materials and iron carbide in combination are the most recommendable.

The carbonaceous materials are carbon black, active carbon, wood charcoal, coal, coke, pitch, asphalt, soot and the like. Particularly desirable are highly surface active materials such as carbon black, active carbon and wood charcoal. Such a substance adhering to a carrier may also be used as the B component.

Iron carbide may be produced by the method previously developed by the same inventors of this composition as described in Japanese Patent Applications Nos. 72839/73, 118644/74, 22272/74 (corresponding to Japanese Patent Application Laying-Open Gazettes Nos. 22000/75, 45700/76 and 116397/75, respectively), etc. It is obtained by thermal decomposition of Prussian blue in an inert or non-oxidizing atmosphere.

The B components used herein also include active clay, iron, nickel and cobalt sulphates and hydrates thereof, and potassium salt or other derivatives of anthraquinone sulphonate. Any one of these can be used singly or in combination with one or more of the other B components previously named.

The A and B components in powder form may be of various diameters. In general, the smaller the diameter, the better thermogenic effect is obtained.

In the invention particle sizes of 10 mesh or finer may be employed, but larger sizes may be used too. A minute amount of water may be present in the A and B components.

The heat generating mechanism of the thermogenic composition of this invention is not clearly known as yet. It is assumed, however, that the heat produced by, as the heat source, the oxidation of the A component with oxygen in the air and that the reaction is catalyzed by the B component. This assumption is supported by the facts that the A component does not generate heat unless it is mixed with the B component, that a large quantity of sulphuric acid radical is detected in the analysis of the thermogenic reaction products. The yield of heat or calorific value (cal/g) of the thermogenic composition of this invention, therefore, is variable according to the A and B components, as the heat sources, and the desired yield of heat, that is, calorific value is obtainable by regulating the mixing ratio of the A and B components. In this case, however, it is preferable that the A component is kept within the range of 10

- 90% by weight. If the ratio is less than 10%, the yield of heat is insufficient and if the ratio exceeds 90%, the thermogenic efficiency falls owing to the insufficient contact with the B component.

The velocity and duration of thermogenic reaction can be controlled as desired by changing the area of contact with air, more specifically, by changing the particle sizes of the A and B components, the quantity of air flow, the kind and quantity of the filler, etc.

The fillers (hereinafter called C component) function as a heat buffer to inhibit a sudden change in temperature due to heat generation and radiation and also as a heat preserver to retain heat; in addition, the fillers may preferably be porous, permeable to the air, and small in specific gravity. They include natural fibers in stape form such as wood dust, cotton linter and cellulose; synthetic fibers in staple form such as polyester staple fibers; waste of foamed synthetic resins such as foamed polystyrene and polyurethane; and other materials such as silica powder, porous silica gel, Glauber's salt (sodium sulphate), barium sulphate, iron oxides and aluminum oxide. The weight ratio of the C component/A and B components may range from 0/100 to 90/10, preferably from 20/80 to 70/30.

Since the thermogenic composition of this invention contains not only the A component but also the B component which is assumed to catalyze the thermogenic reaction of the A component, the control of heat generation will be easy as compared with the other types of composition wherein only the A component is contained even if the filler be not used. As a result, the control of heat and the preservation thereof are possible by using a less quantity of the composition of the present invention.

The thermogenic composition of this invention generates heat of about 100 - 1,100 cal/g in the air, with the highest attainable temperature of above 200° C. For comparison, the conventional iron powder-iron sulphate-water composition yields heat of about 20 cal/g with the highest attainable temperature of below 100° C.

Of the oxygen sources, air is the most convenient and inexpensive. Other materials to serve the purpose include pure oxygen and substances that release oxygen by chemical reactions.

The thermogenic composition of this invention may take various forms of marketable finished goods. In general, it may be vacuum-packed or packed with an inert gas like nitrogen or argon in a bag or vessel made of a material impermeable to air like aluminum foil, a metal vessel or plastic film so that at the time of use the package may be opened to contact the composition with air. Or the A and B components may be separately placed in an air-permeable material and at the time of use they are mixed for heat generation.

The velocity and duration of the thermogenic reaction may be controlled by varying the area of contact with oxygen and other means, that is, varying the weight ratio of the A and B components, diameters of their particles, flow rate of oxygen, kind or quantity of the filler, etc.

The rate of air (oxygen) supply may be controlled by one of the following methods or a combination of some of them:

(1) The thermogenic composition is placed in a container made of air-impermeable material. The container has one or more air inlet holes on the outside wall. The speed of the air supply is controlled by varying the diameter or the number of the holes.

(2) The thermogenic composition is placed in a container made of an air-permeable material and the speed of air supply is controlled by varying the air permeability of the container.

(3) The thermogenic composition is placed in the inner container made of an air-permeable material. The inner container is placed in the outer container made of material impermeable to air. The outer container has an air inlet opening and the speed of air supply is controlled by varying the greatness of the opening.

As an example of the method (1), which uses the container of air-impermeable material such as plastic film or metal foil, 10 - 20g of the thermogenic composition are placed in a bag measuring 8cm × 12cm which has 20 - 40 holes of 2.5mm diameter each. By varying the number of holes it is possible to control the temperature and the duration of heating at desired levels between 50° and 65° C and between 1 and 2.5 hours, respectively.

Similar controls of the temperature and the duration of heating may also be attained by using paper, cloth or their resin-treated products as the material of the container according to the degrees of their air-permeability.

In the case of the method (3), which uses the inner and outer containers, the air inlet opening of the outer container may have the device to open or close the hole or change the opening space so that the temperature of heating as to change the temperature or to suspend the heating midway.

The thermogenic composition in sheet form may be used in a stationary state or in a moving state as in the case it is attached to a human body. Though the air inlet hole has the same opening space there is a difference in the speed of air supply between the two cases causing a difference in temperature attainable by thermogenic reaction. The thermogenic composition of the present invention makes it possible for users to gain the desired temperature or change the temperature when desired by regulating the air supply according to the purpose and mode of its use.

The proper material of the container to hold the thermogenic composition may be selected from a wide range of materials including natural fibers, synthetic fibers, paper, plastic films, and metal foils. Composite materials made up of some of these materials may be used, too. Particularly, it is desirable that the material be made partly or wholly made up of a substance having a high thermal conductivity.

The sheet containing the thermogenic composition of this invention, though its thickness may be as small as 2mm to 5mm, is capable of sufficiently heating other objects since the composition generates a large amount of heat. The use of a highly thermoconductive substance as sheet material may eliminate local variation of heating though the thermogenic composition may be divided into sections with some spaces between them.

The thermogenic composition of this invention generates heat merely by contacting with air without need of water addition. For generation of heat it is necessary, therefore, that its container admits air for supply of oxygen. Since the composition needs no water addition, it may be placed in a thin sheet consisting of small compartments. To make the container permeable to air this invention uses as its material a film or foil with tiny holes, cloth, net, etc. The material may be selected in consideration of the degree of its air permeability to obtain the desired temperature and duration of the heat generation.

In this invention the compartments to contain the thermogenic composition are 1 to 5cm square each. The compartments may be separated by air-permeable walls or may be independent completely. In the case of independent compartments, fairly large spaces may be placed between compartments or between groups of compartments so that the spaces may be used for cutting the sheet or connect separate sheets into desired shapes including non-flat and solid shapes. This way the sheets may be used in belly warmers, shoulder warmers and other articles that warm wide areas of contact.

In order to retain the encased thermogenic composition in its place without undesirable displacement, ensure a uniform generation of heat and a soft structure as the case for the composition, the case or support for the composition may be made of a hair-planted cloth, pile cloth, reticulate sheet, tubular material or it may be screen printed to form thereon compartments defined by relieved lines produced by the printing.

Materials of good thermal conductivity are used for manufacture of the whole or part of the container or support. These materials include metal foil, film or sheet laminated with metal or coated with metal deposited in vapour phase, metal thread sheet or net, and cloth or sheet incorporated with metal granules or powder of metal or other substances.

The thermogenic composition of this invention itself may also be pressed in sheet or pellet form so that it may not be scattered away when part of its covering is opened to contact it with oxygen in the air.

Examples of encased thermogenic composition embodying this invention are given in the following diagrammatic drawings. Of course, practical applications of this invention are not limited to these examples.

Each drawing is a diagrammatic cross-sectional view illustrating a specific encased thermogenic composition embodying the present invention and the manner of its use.

Figure 2:
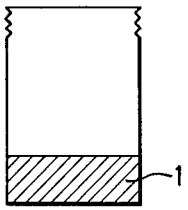
Figure 3:
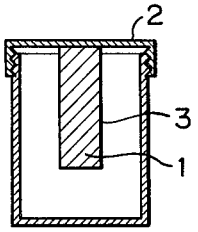
Figure 4:
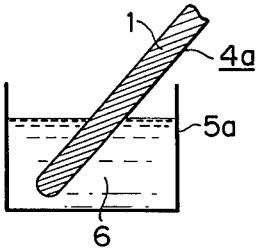
Figure 5:
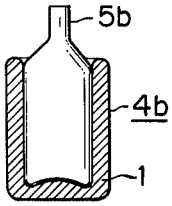
Figure 6:
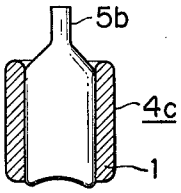
Figure 7:
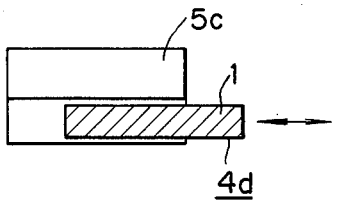
Figure 8:
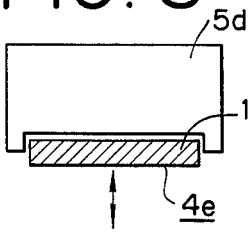

FIG. 1 shows an encased thermogenic composition which is filled between the inner and outer walls of the receptacle or case, the thermogenic composition being designated at 1;

FIG. 2 presents a variation of the case in which the thermogenic composition 1 is packed between the double bottom walls;

FIG. 3 shows another variation of the encased thermogenic composition of FIG. 1, in which variation a heat conductive oxygen-impermeable coat 3 enclosing the composition 1 is fitted to a lid 2;

FIG. 4 shows a thermogenic composition 1 enclosed in a rod-like case 3 and the encased composition body **4*a* partly inserted into a container 5*a* for heating the contents 6** therein;

FIG. 5 shows an encased thermogenic composition body **4*b* in which a container 5*b*** is placed for heating sake (Japanese rice wine), coffee, milk or the like therein;

FIG. 6 shows another variation of the encased composition body **4*b* of FIG. 5, in which variation a container 5*b* is surrounded with the encased composition body 4*c* in flexible sheet form for heating the contents in the container; and FIGS. 7 and 8 show encased thermogenic composition bodies 4*d* and 4*e* which may removably be contacted closely with containers 5*c* and 5*d*, respectively. If the containers 5*c* and 5*d* are disposable ones in FIGS. 7 and 8, the encased thermogenic compositions 4*d* and 4*e*** may of course be fitted to the containers, respectively.

In order to allow the encased thermogenic composition to generate heat, the composition may only be contacted with oxygen gas, usually air, as previously mentioned. This is achieved by perforating the oxygen gas-impermeable case with something like a needle, by peeling off from the case at least one oxygen gas-impermeable cover film sealably covering at least one perforation or opening previously provided on the case, by using a so-called easy opening mechanism such as pull-tab, by using a screw-type perforating mechanism or by other suitable means.

The encased thermogenic compositions may be surrounded with known thermal insulating materials and they may also be closely contacted with bodies to be heated by the use of an adhesive therebetween.

Since the thermogenic compositions of this invention can have a calorific power of at least 1,000 cal/g as previously mentioned, it is possible to produce encased thermogenic compositions having a composition suitable for their use and being capable of controllably generating heat.

The encased thermogenic composition may characteristically be used for heating ready-to-cook foods such as retortable pouch, canned and bottled foods, and noodle, for heating coffee, sake, milk, diet for patients, field rations and the like; for thawing frozen foods, for warming window glass to prevent freezing and frosting of moisture thereon in frigid zones; for pocket heaters and warmed wet dressing as a heat source; for thermally volatilizing insecticides, fungicides, perfumes and the like; for heating plastics for welding; for hot-melt adhesives as a heat source; for warming battery-powered communications and the like; for heating to evolve gases; for warming shoes, gloves and the like; for substituting for portable fuel; and for warming mats and the like.

This invention will be better understood by the following Examples wherein all parts are by weight unless otherwise specified.

EXAMPLE 1

Sodium sulphide pentahydrate having a particle size of about 100 μm and powdered activated carbon having a particle size of not greater than 1 μm, the total amount of these two ingredients being 1 g, were mixed together in the weight ratios shown in the following Table thereby to obtain thermogenic compositions. Each of the thermogenic compositions so obtained was enclosed or encased in a 50-ml glass ampoule in a nitrogen atmosphere, thoroughly mixed and then exposed to the air by opening the ampoule thereby to obtain a calorific value shown in the following Table 1.

Table 1

| Activated carbon | Sodium sulphide pentahydrate | Calorific value (cal/g) |
|---|---|---|
| 1 Part(s) | 9 Parts | 110 |
| 2 Part(s) | 8 Parts | 295 |
| 4 Part(s) | 6 Parts | 230 |
| 6 Part(s) | 4 Parts | 100 |

The measurement of calorific value of each thermogenic composition encased in the glass ampoule was effected by placing the encased composition in the sample room of an adiabatic calorimeter immersed in a thermostatic tank, breaking the glass ampoule and then measuring a rise in temperature of the water in the calorimeter while passing dry air at a predetermined flow rate and a predetermined temperature for contact with the composition, from which temperature rise the calorific value of the thermogenic composition was calculated.

EXAMPLE 2

The procedure of Example 1 was followed except that carbon black of 16 nm in particle size for paints (produced under the trademark of No. 999 by Columbian Carbon Co., Ltd.) and sodium polysulphide having passed through a 20 mesh screen (produced by Yoneyama Pharmaceutical Industrial Co., Ltd.) were substituted for the activated carbon black and the sodium sulphide as shown in the following Table 2, thereby to find the calorific value of each thermogenic composition as shown in Table 2.

Table 2

| Carbon black | Sodium polysulphide | Calorific value (cal/g) |
|---|---|---|
| 1 Part(s) | 9 Parts | 250 |
| 4 Part(s) | 6 Parts | 1,200 |
| 6 Part(s) | 4 Parts | 200 |
| 8 Part(s) | 2 Parts | 500 |

EXAMPLE 3

The procedure of Example 1 was followed, but substituting powdered graphite having passed through a 48 mesh screen and potassium sulphide pentahydrate having passed through a 20 mesh screen for the activated carbon and the sodium sulphide as shown in the following Table 3, thereby to find the calorific value of each thermogenic composition as shown in Table 3.

Table 3

| Graphite | Potassium sulphide pentahydrate | Calorific value (cal/g) |
|---|---|---|
| 1 Part(s) | 9 Parts | 100 |
| 4 Part(s) | 6 Parts | 210 |
| 6 Part(s) | 4 Parts | 320 |
| 8 Part(s) | 2 Parts | 250 |

EXAMPLE 4

The procedure of Example 1 was followed except that powdered iron carbide having an about 10-μm particle size was substituted for the activated carbon as shown in the following Table 4, thereby to find the calorific value of each thermogenic composition as shown in Table 4.

Table 4

| Iron carbide | Sodium sulphide pentahydrate | Calorific value (cal/g) |
|---|---|---|
| 9 Parts | 1 Part(s) | 110 |
| 8 Parts | 2 Part(s) | 230 |
| 6 Parts | 4 Part(s) | 295 |
| 4 Parts | 6 Part(s) | 100 |

EXAMPLE 5

The procedure of Example 1 was repeated except that powdered iron carbide having passed through an about 10 μm mesh screen and sodium sulphide anhydrate having passed through a 48 mesh screen as shown in the following Table 5, thereby to find the calorific value of each thermogenic composition as shown in Table 5.

Table 5

| Iron Carbide | Sodium sulphide anhydrate | Calorific value (cal/g) |
|---|---|---|
| 9 Parts | 1 Part(s) | 185 |
| 8 Parts | 2 Part(s) | 495 |
| 6 Parts | 4 Part(s) | 525 |
| 4 Parts | 6 Part(s) | 280 |

EXAMPLE 6

Following the procedure of Example 1, but substituting powdered iron carbide having an about 10-μm particle size and potassium sulphide pentahydrate having passed through a 20 mesh screen, there was obtained the calorific value of each thermogenic composition as indicated in Table 6.

Table 6

| Iron carbide | Potassium sulphide pentadehydrate | Calorific value (cal/g) |
|---|---|---|
| 9 Parts | 1 Part(s) | 100 |
| 8 Parts | 2 Part(s) | 210 |
| 6 Parts | 3 Part(s) | 320 |
| 4 Parts | 4 Part(s) | 250 |

EXAMPLE 7

Following the procedure of Example 1, but substituting powdered iron carbide having an about 10-μm particle size and sodium polysulphide having passed through a 20 mesh screen as shown in Table 7, there was obtained the calorific value of each thermogenic composition as shown in Table 7.

Table 7

| Iron carbide | Sodium polysulphide | Calorific value (cal/g) |
|---|---|---|
| 9 Parts | 1 Part(s) | 250 |
| 8 Parts | 2 Part(s) | 500 |
| 6 Parts | 4 Part(s) | 1,200 |
| 4 Parts | 6 Part(s) | 200 |

Comparative example

There were prepared a thermogenic composition of this invention having the following composition and a conventional thermogenic composition having the following composition. For comparison, the novel and conventional thermogenic compositions were tested for calorific value with the result being shown in the following Table.

Table

| Conventional thermogenic | | Novel thermogenic | |
|---|---|---|---|
| Composition | (5g) | Composition | (5g) |
| Powdered iron | 3g | Iron carbide | 3g |
| Ferric sulphate | 1g | Sodium sulphide pentahydrate | 2g |
| Water | 1g | | |
| Calorific value | 20 cal/g | Calorific value | 230 cal/g |

From this Table it is seen that the thermogenic composition of this invention exhibited remarkably high calorific value and excellent performances as compared with the conventional one.

EXAMPLE 8

Following the procedure of Example 1, but substituting sodium sulphide pentahydrate having a particle size of about 100 μm, powdered activated carbon having particle sizes of not greater than 1 μm and iron carbide having a particle size of about 10 μm as shown in the following Table 8, there were obtained thermogenic compositions which were then tested for their calorific value. The composition and calorific value of each thermogenic composition are indicated in Table 8.

Table 8

| Activated carbon | Iron carbide | Sodium sulphide pentahydrate | Calorific value (cal/g) |
|---|---|---|---|
| 2 Parts | 3 Part(s) | 5 Parts | 220 |
| 2 Parts | 4 Part(s) | 4 Parts | 205 |
| 3 Parts | 1 Part(s) | 6 Parts | 240 |
| 3 Parts | 2 Part(s) | 5 Parts | 250 |
| 3 Parts | 3 Part(s) | 4 Parts | 215 |
| 4 Parts | 1 Part(s) | 5 Parts | 270 |
| 4 Parts | 2 Part(s) | 4 Parts | 230 |
| 5 Parts | 1 Part(s) | 4 Parts | 230 |

EXAMPLE 9

Carbon black for paints, having a particle size of 16 nm (produced under the Trademark of No. 999 by Columbian Carbon Co., Ltd.), iron carbide having a particle size of about 10 μm and sodium polysulphide having passed through a 20 mesh screen, were mixed together in the ratios shown in the following Table 9 in the same manner as in Example 1 thereby to obtain thermogenic compositions which were then measured for calorific value. The results are shown in Table 9.

Table 9

| Carbon black | Iron carbide | Sodium polysulphide | Calorific value (cal/g) |
|---|---|---|---|
| 2 Parts | 3 Part(s) | 5 Parts | 895 |
| 3 Parts | 1 Part(s) | 6 Parts | 960 |
| 3 Parts | 2 Part(s) | 5 Parts | 1,000 |
| 4 Parts | 1 Part(s) | 5 Parts | 1,080 |
| 4 Parts | 2 Part(s) | 4 Parts | 930 |
| 5 Parts | 1 Part(s) | 4 Parts | 905 |

EXAMPLE 10

Powdered graphite having passed through a 48 mesh screen, iron carbide having a particle size of about 10 μm and potassium sulphide pentahydrate having passed through a 20 mesh screen, were mixed together thereby to obtain thermogenic compositions which were measured for calorific value with the results being shown in the following Table 10.

Table 10

| Graphite | Iron carbide | Potassium sulphide pentahydrate | Calorific value (cal/g) |
|---|---|---|---|
| 2 Parts | 3 Part(s) | 5 Parts | 160 |
| 3 Parts | 1 Part(s) | 6 Parts | 185 |
| 3 Parts | 2 Part(s) | 5 Parts | 190 |
| 4 Parts | 1 Part(s) | 5 Parts | 210 |
| 4 Parts | 2 Part(s) | 4 Parts | 175 |
| 5 Parts | 1 Part(s) | 4 Parts | 180 |

EXAMPLE 11

Carbon black having a particle size of 16 nm (produced under the trademark of Mitsubishi Carbon Black No. 900 by Mitsubishi Kasei Co., Ltd.) and sodium hydrosulphide dihydrate having passed through a 20 mesh screen, were mixed together to form thermogenic compositions which were then measured for calorific value in the same manner as in Example 1. The results are shown in the following Table 11.

Table 11

| Carbon black | Sodium hydrosulphide dihydrate | Calorific value (cal/g) |
|---|---|---|
| 9 Parts | 1 Part(s) | 75 |
| 7.5 Parts | 2.5 Part(s) | 472 |
| 6 Parts | 4 Part(s) | 645 |
| 5 Parts | 5 Part(s) | 521 |
| 4 Parts | 6 Part(s) | 183 |

Example 12

Five parts of sodium sulphide pentahydrate having a particle size of about 100 μm, 1 part of carbon black having a particle size of 16 μm (produced under the trademark of Mitsubishi Carbon Black No. 900 by Mitsubishi Kasei Co., Ltd.), 1 part of iron carbide having a particle size of about 10 μm, 2 parts of powdered microcrystalline cellulose having a particle size of about 40 μm (produced under the trademark of Avicel PH 101 by Asahi Kasei Kogyo Co., Ltd.) and 1 part of anhydrous sodium carbonate having passed through a 48 mesh screen, were mixed together to produce a thermogenic composition which was then measured for calorific value in the same manner as in Example 1. The calorific value obtained was 290 cal/g.

EXAMPLES 13 - 17

Thermogenic compositions were prepared by mixing together sodium sulphide pentahydrate having a particle size of about 100 μm, carbon black having a particle size of about 16 nm (produced under the trademark of Mitsubishi Carbon Black No. 900 by Mitsubishi Kasei Co., Ltd.), iron carbide having a particle size of about 10 μm and, as a temperature buffer agent, celite (made mainly of diatomaceous earth) having a particle size of about 100 μm, in the various ratios shown in the following Table 13.

Each of the thermogenic compositions so prepared was charged in a cloth-made bag or case, 80mm wide and 120mm long, and the whole mass was put in a polyester film-made case which was then so perforated to provide holes of 2.5mm in diameter for vent as indicated in the following Table 13, thereby to test the thermogenic composition for its maximal temperature (°C) attainable and duration (min.) of heat generation at not lower than 40° C. The results are shown in Table 13.

Table 13

| | Constitution of thermogenic composition (wt. ratio) | | | | Amount of thermogenic composition used | Number of vents | | | | | |
|---|---|---|---|---|---|---|---|---|---|---|---|
| | | | | | | 18 | | 24 | | 39 | |
| Example | $Na_2S$ $5H_2O$ | Carbon black | $Fe_3C$ | Celite | (g) | Temp. | Min. | Temp. | Min. | Temp. | Min. |
| 13 | 50 | 13 | 5 | 32 | 10 | 48 | 90 | 52 | 80 | 61 | 50 |
| 14 | 50 | 13 | 5 | 32 | 15 | 50 | 120 | 53 | 95 | 55 | 60 |
| 15 | 59 | 12 | 6 | 23 | 15 | 53 | 110 | 57 | 105 | 64 | 90 |
| 16 | 59 | 12 | 6 | 23 | 20 | 50 | 140 | 58 | 130 | 65 | 120 |
| 17 | 67 | 13 | 7 | 13 | 18 | 46 | 150 | 48 | 130 | 55 | 70 |

EXAMPLE 18

Fifty-eight parts of sodium sulphide pentahydrate having a particle size of about 100 μm, 12 parts of carbon black having a particle size of 16 μm (produced under the trademark of Mitsubishi Carbon Black No.

900), 6 parts of iron carbide having a particle size of about 10 μm and 23 parts of celite having a particle size of about 100 μm, were mixed together to produce a thermogenic composition.

Two to four grams of the thermogenic composition so produced were placed in each compartment, 4cm × 4cm, provided with 3 to 6 vents of 2.5mm in diameter of two cases consisting of many such compartments. One of the cases was a control made of polyester film and the other is made of a laminate of a polyester film with a 15 μm thick aluminum foil. The polyester film case was identical with the laminate case in size and number of compartments.

The polyester film-encased thermogenic composition generated heat at an average temperature of 52° - 55° C with a difference of ±4° - 5° C between the local temperatures, while the aluminum laminate-encased one generated heat at an average temperature of 50° - 52° C with a difference of ±1° - 2° C between the local temperatures, this indicating that the latter composition could be a thermogenic sheet generating heat at a uniform temperature due to the high heat conductivity of the aluminum.

The thickness of the thermogenic sheet varies depending on the composition and amount of the thermogenic composition encased in the compartment, and it may usually be in the range of 2 - 20mm.

What is claimed is:

1. A thermogenic composition comprising (A) at least one compound selected from the group consisting of alkali metal sulphides, polysulphides, hydrosulphides, hydrates thereof and mixtures thereof and (B) at least one compound selected from the group consisting of (1) carbonaceous material, (2) iron carbide, (3) activated clay, (4) iron, nickel and cobalt sulphates and hydrates thereof and (5) potassium salt of anthraquinone sulphonate.

2. A thermogenic composition according to claim 1, further comprising a filler (C).

3. A thermogenic composition according to claim 2, wherein the filler (C) is selected from the group consisting of waste of foamed synthetic resins, silica powder, porous silica gel, Glauber's salt, barium sulphate, iron oxides, aluminum oxide and natural and synthetic staple fibers selected from the group consisting of wood dust, cotton linter, cellulose and polyester in staple fiber form.

4. A thermogenic composition according to claim 1, wherein the compound (A) is present in an amount of 10 - 90% by weight of the composition.

5. A thermogenic composition according to claim 1, wherein the compound (A) is present in an amount of 10 - 90% by weight of the composition.

6. A thermogenic composition according to claim 2, wherein the compound (A) is present in an amount of 10 - 90% by weight of the total of the compounds (A) and (B), and the filler (C) is present in a ratio by weight of from 0/100 to 90/10 between the filler (C) and the total of the compounds (A) and (B).

7. A thermogenic composition according to claim 3, wherein the compound (A) is present in an amount of 10 - 90% by weight of the total of the compounds (A) and (B), and the filler (C) is present in a ratio by weight of from 0/100 to 90/10 between the filler (C) and the total of the compounds (A) and (B).

* * * * *